US006312233B1

(12) United States Patent
Ahn et al.

(10) Patent No.: US 6,312,233 B1
(45) Date of Patent: Nov. 6, 2001

(54) ROTARY COMPRESSOR

(75) Inventors: Byung Ha Ahn, Pusan-Kwangyokshi; Jang Woo Lee; Young Jong Kim, both of Kyongsangnam-do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/392,450

(22) Filed: Sep. 9, 1999

(30) Foreign Application Priority Data

Feb. 26, 1999 (KR) ..... 99/6453

(51) Int. Cl.[7] ..... F04B 53/00
(52) U.S. Cl. ..... 417/312; 417/313
(58) Field of Search ..... 417/312, 313, 417/269, 540; 415/119; 418/15, 63, 60; 62/296; 181/403

(56) References Cited

U.S. PATENT DOCUMENTS 4,881,879 * 11/1989 Ortiz ..... 417/312
4,971,529 * 11/1990 Gannaway et al. ..... 417/313
5,339,652 * 8/1994 Dreiman ..... 62/296

* cited by examiner

*Primary Examiner*—Teresa Walberg
*Assistant Examiner*—Quang Van
(74) *Attorney, Agent, or Firm*—Fleshner & Kim, LLP

(57) ABSTRACT

Rotary compressor for attenuating a noise generated in operation of the rotary compressor and improving lubrication, including a main bearing which is a component for forming a compression chamber having a discharge passage for discharging a compressed gas and a boss for inserting a shaft of a motor therethrough, and a muffler on a top of the main bearing having a boss hole for passing the boss of the main bearing therethrough and provided for attenuation of a noise, wherein the muffler has no separate refrigerant discharge opening, the boss of the main bearing has a plurality of first discharge openings, and the shaft has a hollow and a plurality of second discharge openings in communication with the first discharge openings.

18 Claims, 7 Drawing Sheets

Section I – I

ROTARY COMPRESSOR

BACKGROUND OF THE INVENTION

1. Field of the Invention

The present invention relates to a rotary compressor, and more particularly, to a rotary compressor which can attenuate a noise generated in operation of the rotary compressor and improve lubrication.

2. Background of the Related Art

The compressor for compressing air or gas to a required pressure is used in an air conditioner or the like for compressing a refrigerant gas to a required pressure.

A related art rotary compressor will be explained with reference to FIGS. 1 and 2.

The related art rotary compressor is provided with a hermetic case 1 having a suction pipe 16 for drawing refrigerant and a discharge pipe 5 for discharging the compressed refrigerant, both connected thereto respectively, a driving unit 6 in the case 1 for providing a rotating force, and a compression unit 10 for compressing the refrigerant. The driving unit 6 has a stator 2 and a rotor 3 of a motor disposed at an upper portion in the case 1. The rotor 3 is coupled to a shaft 4 for transmission of the rotating power to the compression unit 10. The rotor 3 has an eccentric portion 4*a* at a lower portion thereof. The compression unit 10 has a compression chamber 'C' enclosed by a cylinder 11 forming a wall of the compression chamber 'C', and a main bearing 14 and a supplementary bearing 15 mounted at an upper side and a lower side of the compression chamber 'C' respectively. The compression chamber 'C' has the suction pipe 16 connected thereto for receiving refrigerant from outside of the compression chamber 'C'. The cylinder 11 and the main bearing 14 have a discharge opening 11*a* and a discharge passage 14*b* formed therein respectively for discharging refrigerant, which discharge passage 14*b* is opened/closed by a valve(not shown). In the meantime, the eccentric portion 4*a* of the shaft is mounted in the compression chamber 'C', i.e., inside of the cylinder 11. There is a roller 12 fitted to an outside of the eccentric portion 4*a* for making a compression action as the eccentric portion 4*a* keeps making contact with an inside surface of the cylinder 11 following rotation of the eccentric portion 4*a*. And, there is a vane 13 mounted in the cylinder 11 to be always in contact with an outside of the roller 12 biased by a spring for dividing the compression chamber 'C' into a high pressure portion and a low pressure portion. There is a muffler 20 above the main bearing 14 for attenuation of noise, which has a muffler discharge opening 21 for discharging refrigerant flowed into the muffler 20 to an outside of the muffler 20.

The muffler will be explained with reference to FIGS. 3A–3B.

The muffler 20 in a form of a cap has a boss hole 22 at a center for passing a boss portion 14*a* of the main bearing 14, and recessed bolt fixing parts 23 in an outer circumference thereof. The muffler 20 has a muffler discharge opening 21 formed at a position between an inside diameter and an outside diameter for discharging the compressed gas flowed into the muffler 20.

In the meantime, lubrication oil is applied to various components of the compressor for smooth operation. That is, a pump(not shown) draws lubricating oil stored on a bottom of the case 1 and supplies to between the main bearing 14 or the supplementary bearing 15 and the shaft 4 through a hollow 4*b* in the shaft 4. As the lubrication oil and the refrigerant are mixed in a process of refrigerant circulation, and discharged to outside of the compressor, there is an accumulator 30 provided on the suction pipe 16 side of the compressor for separating and recovering the lubrication oil.

The operation of the related art rotary compressor will be explained with reference to FIGS. 1 and 2.

Upon starting the rotary compressor, the rotor 3 of the motor is rotated, to rotate the eccentric portion 4*a* of the shaft, eccentrically rotating the roller 12 inside of the cylinder 11 in a state the roller 12 is in contact with the vane 13. The eccentric rotation of the roller 12 reduces a volume of the compression chamber 'C', compressing low pressure refrigerant flowed into the compression chamber 'C' through the suction pipe 16 to a required pressure. Following operation of the valve, the compressed high pressure refrigerant is discharged into the muffler 20 above the main bearing 14 through the cylinder discharge opening 11*a* and the discharge passage 14*b* in the main bearing. The high pressure refrigerant thus discharged into the muffler 20 is discharged outside of the muffler 20 through the muffler discharge opening 21. And, the high pressure refrigerant discharged outside of the muffler 20 is discharged outside of the rotary compressor through the discharge pipe 5 on top of the case 1 through gaps between the rotor 3 and the stator 2 or the case 1 and the stator 2. And, the high pressure refrigerant discharged outside of the compressor through the discharge pipe 5 is circulated through a refrigerating cycle to flow into the compressor again through the suction pipe 16.

However, the related art rotary compressor has the following problems.

First, because a pressure fluctuation and a kinetic turbulent energy contained in the compressed refrigerant is discharged without being consumed fully, noise can not be attenuated, effectively. And, a size of noise generation is directional depending on a position of a muffler discharge opening formed in the muffler. Moreover, the related art muffler has a limitation in attenuating the noise for a large sized compressor because the pressure fluctuation of the compressed refrigerant is substantial.

Second, since the hollow in the shaft merely serves in supplying lubricating oil to the main bearing and the supplementary bearing, and the lubricating oil supply fully depends on the pump, an overall compressor efficiency is dropped.

Third, because the high pressure refrigerant compressed in the compression chamber flows into the muffler through a discharge passage formed in one side of the main bearing, exerting an eccentric load to the shaft, a lifetime of the shaft is shortened.

SUMMARY OF THE INVENTION

Accordingly, the present invention is directed to a rotary compressor that substantially obviates one or more of the problems due to limitations and disadvantages of the related art.

One object of the present invention is to provide a rotary compressor which can improve a noise attenuation performance.

Other object of the present invention is to provide a rotary compressor which can improve a lubrication for improving a compressor performance.

Another object of the present invention is to provide a rotary compressor which can prolong a lifetime of the shaft.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the rotary compressor including a main bearing which is a component for forming a compression chamber having a discharge passage for discharging a compressed gas and a boss for inserting a shaft of a motor therethrough, and a muffler on a top of the main bearing having a boss hole for passing the boss of the main bearing therethrough and provided for attenuation of a noise, wherein the muffler has no separate refrigerant discharge opening, the boss of the main bearing has a plurality of first discharge openings, and the shaft has a hollow and a plurality of second discharge openings in communication with the first discharge openings.

There is a lubrication cavity between the first discharge openings in the main bearing and the second discharge openings in the shaft, for collection of the lubrication oil mixed with the refrigerant.

In other aspect of the present invention, there is provided a rotary compressor including a main bearing which is a component for forming a compression chamber having a discharge passage for discharging a compressed gas and a boss for inserting a shaft of a motor therethrough, and a muffler on a top of the main bearing having a boss hole for passing the boss of the main bearing therethrough and provided for attenuation of a noise, wherein the muffler has no separate refrigerant discharge opening, a top of the muffler is extended over a top of the boss of the main bearing, and the shaft has a hollow and a plurality of refrigerant discharge openings.

Accordingly, the rotary compressor of the present invention can attenuate noise effectively, and improve lubrication, thereby improving a compressor efficiency.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
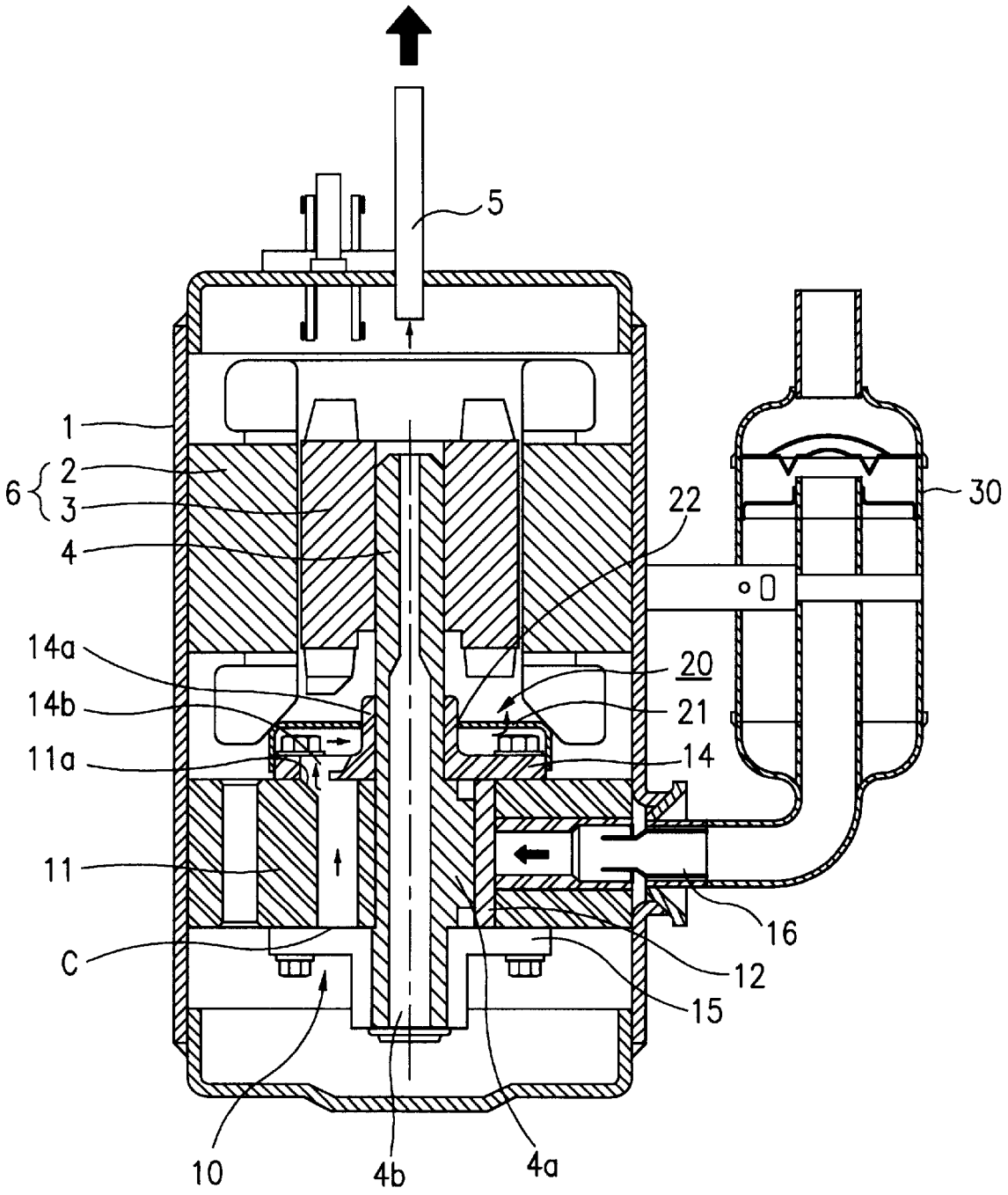
FIG.1 Related Art
FIG. 1 illustrates a longitudinal section of a related art rotary compressor.
Figure 2:
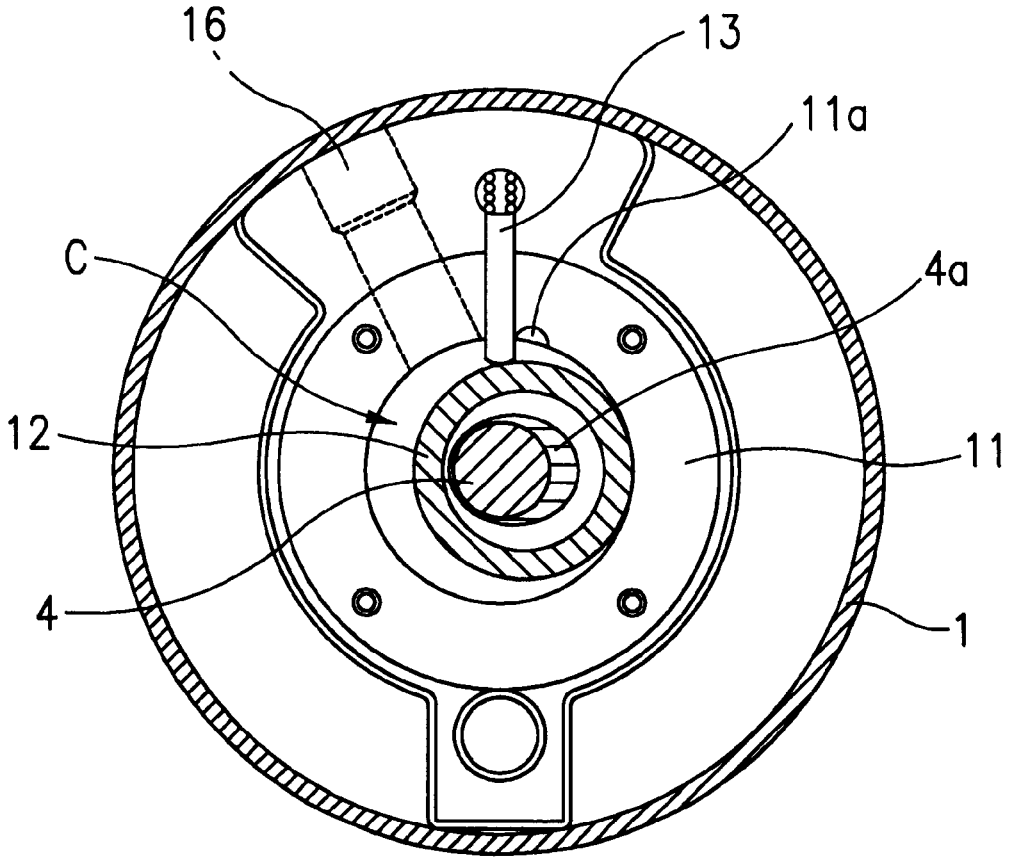
FIG.2 Related Art
FIG. 2 illustrates a transverse section of a related art rotary compressor.
Figure 3A:
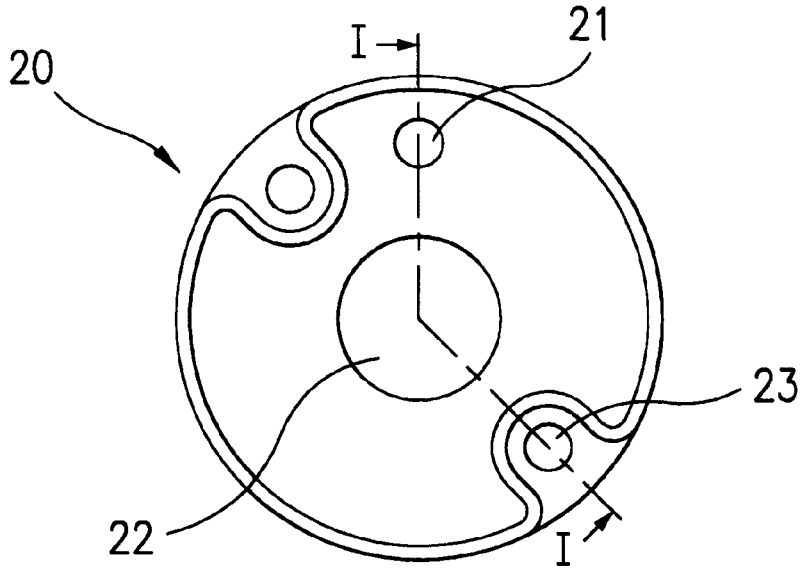
FIG.3A Related Art
FIG. 3A illustrates a plan view.
Figure 3B:
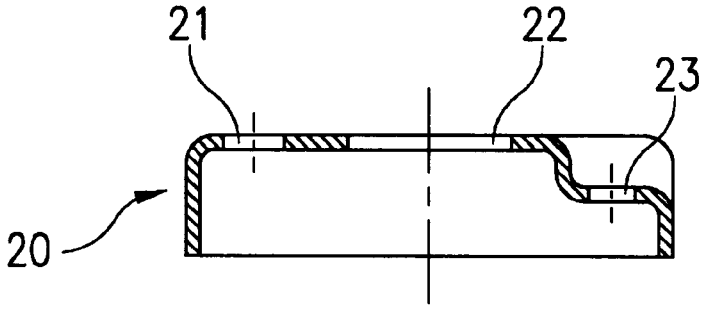
FIG.3B Related Art
FIG. 3B illustrates a sectional view across line I—I of a muffler for a related art rotary compressor.
Figure 4A:
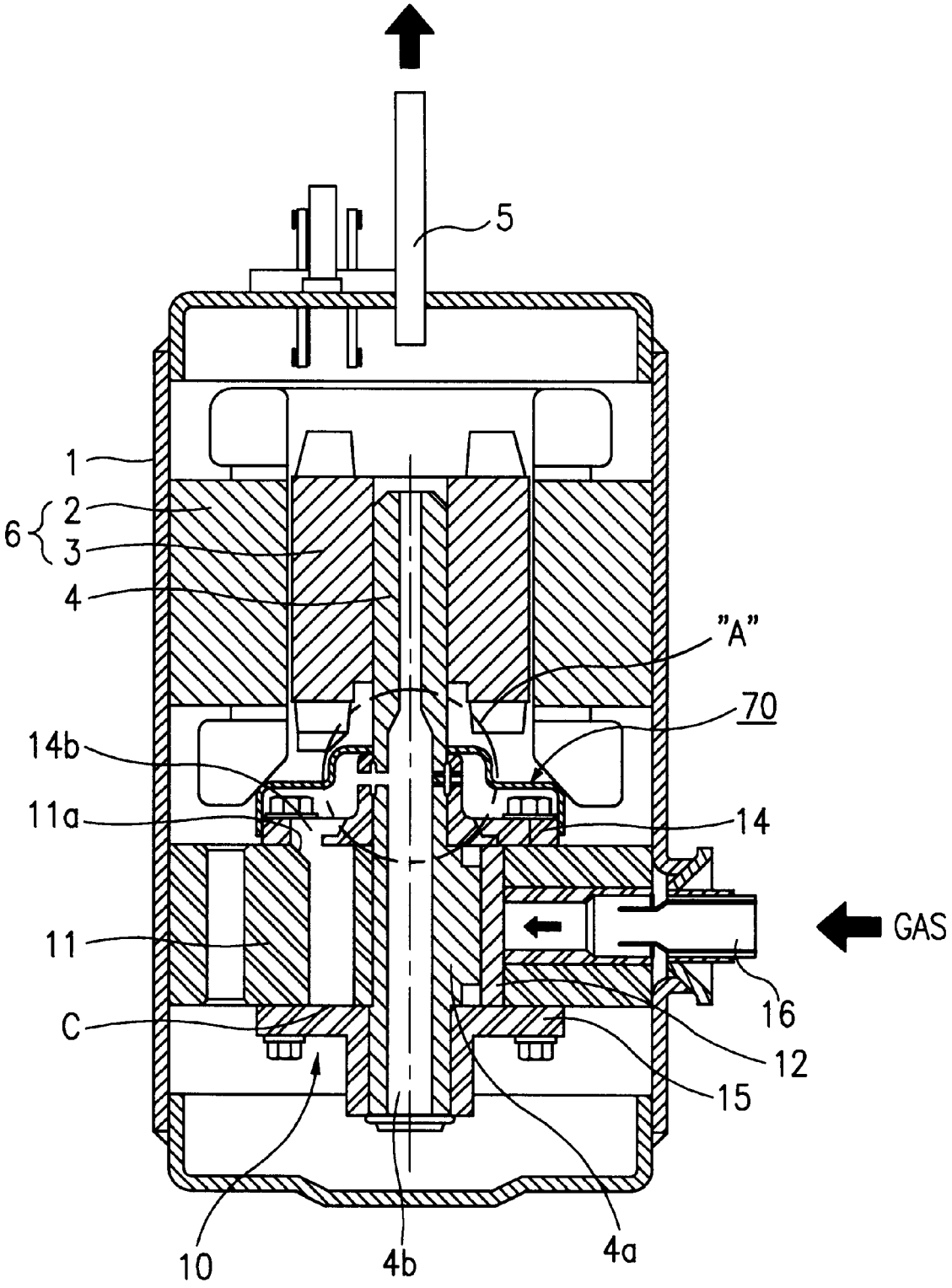
FIGS. 4A and 4B illustrate a longitudinal section of a rotary compressor in accordance with one preferred embodiment of the present invention.
Figure 4B:
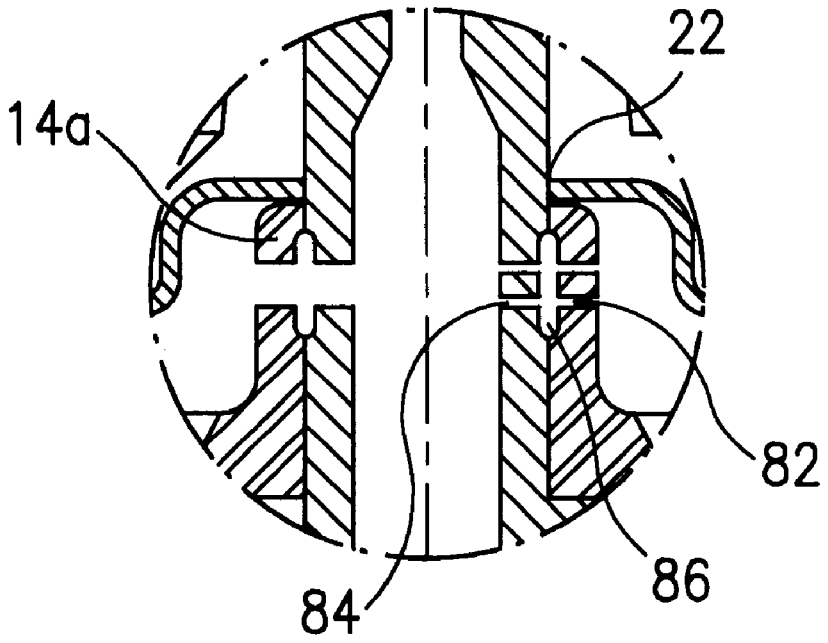

Reference will now be made in detail to the preferred embodiments of the present invention, examples of which are illustrated in the accompanying drawings. FIGS. 4A and 4B illustrate a longitudinal section of a rotary compressor in accordance with one preferred embodiment of the present invention, referring to which the present invention will be explained. Components identical to the related will be given the same reference names and numbers, and detailed explanations for the identical components will be omitted.

An overall structure of the rotary compressor of the present invention is identical to the related art rotary compressor, except a refrigerant discharge opening. That is, the present invention provides a refrigerant discharge opening, not in the muffler directly, but in the shaft with a hollow and a boss of a main bearing respectively, for discharging the refrigerant to outside of the muffler.

The rotary compressor of the present invention will be explained with reference to FIG. 4.

Figure 6A:
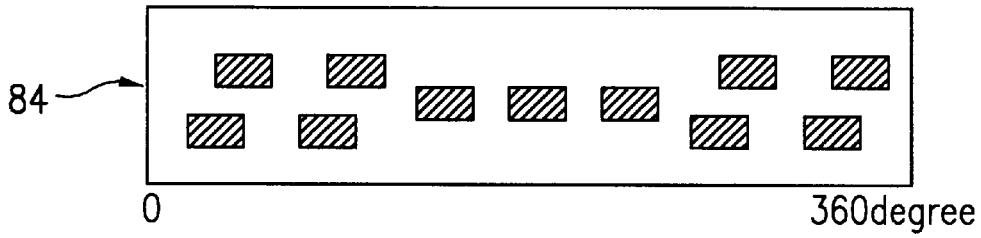
FIGS. 6A and 6B illustrate a developed view of a main bearing and a shaft for explaining positions of the first discharge opening and the second discharge opening shown in FIGS. 4A and 4B.
Figure 6B:
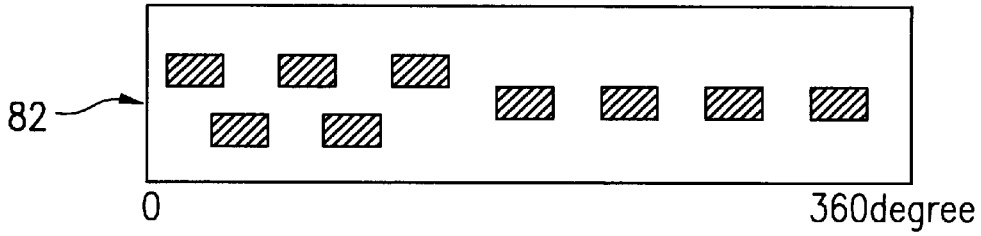

Referring to FIGS. 4A and 4B, the muffler 70 of the present invention has a form of a cap the same as the related art, with a boss hole 22 at a center thereof for passing a boss 14*a* of the main bearing 14. However, different from the related art, the muffler 70 has no discharge opening formed therein, separately. In the meantime, the boss 14*a* of the main bearing 14 has a plurality of first discharge openings 82 formed therein, and the shaft 4 has a plurality of second discharge openings 84 in communication with the first discharge openings 82. Of course, the first discharge openings 82 and the second discharge openings 84 should be formed at positions to be within an inside of the muffler 70. In this instance, because the shaft 4 rotates even if the main bearing 14 is fixed, an appropriate combination of positions of the first discharge openings 82 and the second discharge openings 84 is important for permitting communication between the first discharge openings 82 in the boss 14*a* of the main bearing 14 and the second discharge openings 84 in the shaft 4. Therefore, as shown in FIGS. 6A and 6B, the first discharge openings 82 and the second discharge openings 84 are preferably formed to be arranged in zigzag.

In the meantime, the discharge of the compressed high pressure refrigerant from the discharge passage 14*b* in the main bearing 14 to the inside of the muffler 70 causes an eccentric load to exert to the shaft 4 at a position in the vicinty of the discharge passage 14*b*. Therefore, it is preferable that a plurality of the first discharge openings 82 in the boss 14*a* of the main bearing 14 are formed at positions substantially opposite to the discharge passage 14*b* in the main bearing 14, for offsetting the eccentric load in protection of the shaft 4. It is more preferably that a portion of an inside diameter of the main bearing 14 and a portion of an outside diameter of the shaft 4 are machined to form a lubricating cavity 86. Because the lubricating cavity collects the lubricating oil contained in the refrigerant, which flows into a gap between the main bearing 14 and the shaft 4, that allows a smoother lubrication.

The operation of the rotary compressor of the present invention will be explained with reference to FIGS. 4A and 4B.

First, the high pressure refrigerant compressed in the compression chamber 'C' is flowed into an inside of the muffler 70 through the cylinder discharge opening 11*a* and the discharge opening 14*b* in the main bearing. Because there is no separate refrigerant discharge opening formed in the muffler 70, the refrigerant is discharged to the hollow 4*b* in the shaft 4 through the first discharge openings 82 in the main bearing 14 and the second discharge openings 84 in the shaft 4. The refrigerant discharged into the hollow 4*b* is discharged to an upper portion of the case 1 through the hollow 4*b,* and the refrigerant discharged to the upper portion of the case 1, alike in the case of related art, is discharged outside of the rotary compressor through the discharge pipe 5 via a gap between the stator 2 and the rotor 3 or a gap between the case 1 and the stator 2.

Figure 5:
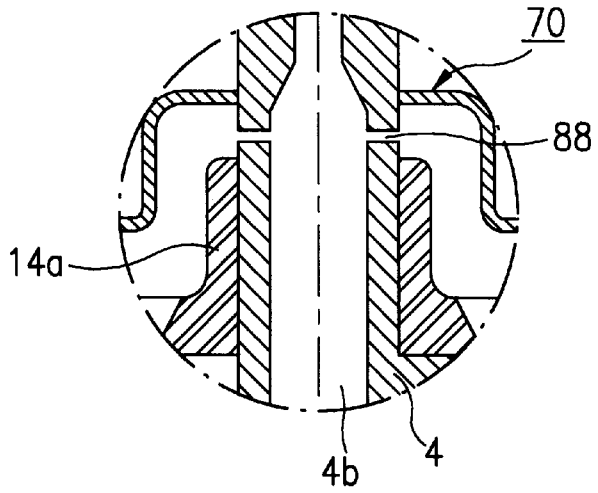
FIG. 5 illustrates a longitudinal section of a rotary compressor in accordance with another preferred embodiment of the present invention.

In the meantime, even though the aforementioned embodiment shows the first discharge openings 82 and the second discharge openings 84 formed in the main bearing 14 and in the shaft 4 respectively, the present invention is not limited to this. That is, as shown in FIG. 5, it is possible that a top of the muffler 70 is extended to a position higher than a top of the boss 14*a* of the main bearing 14, and a refrigerant discharge opening 88 which permits flow of the refrigerant only through the shaft 4 is formed. This permits a simpler structure as the refrigerant discharge opening may not be formed in the main bearing 14.

The rotary compressor of the present invention has the following advantages.

Figure 7A:
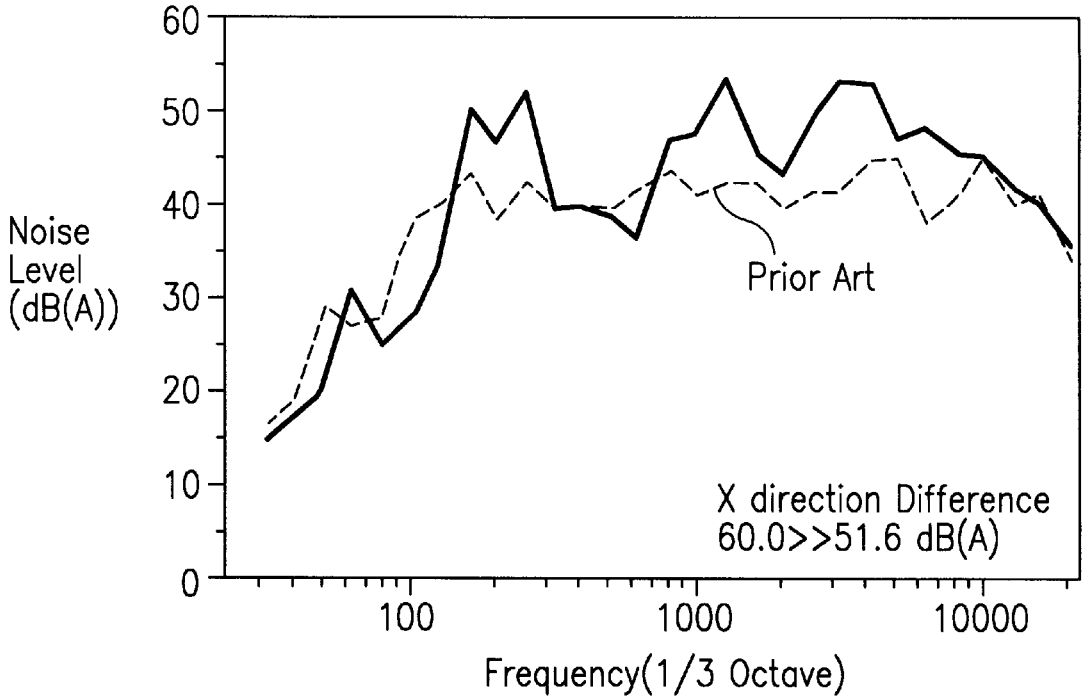
FIGS. 7A and 7B illustrate graphs of noise levels of rotary compressors in the related art and the present invention.
Figure 7B:
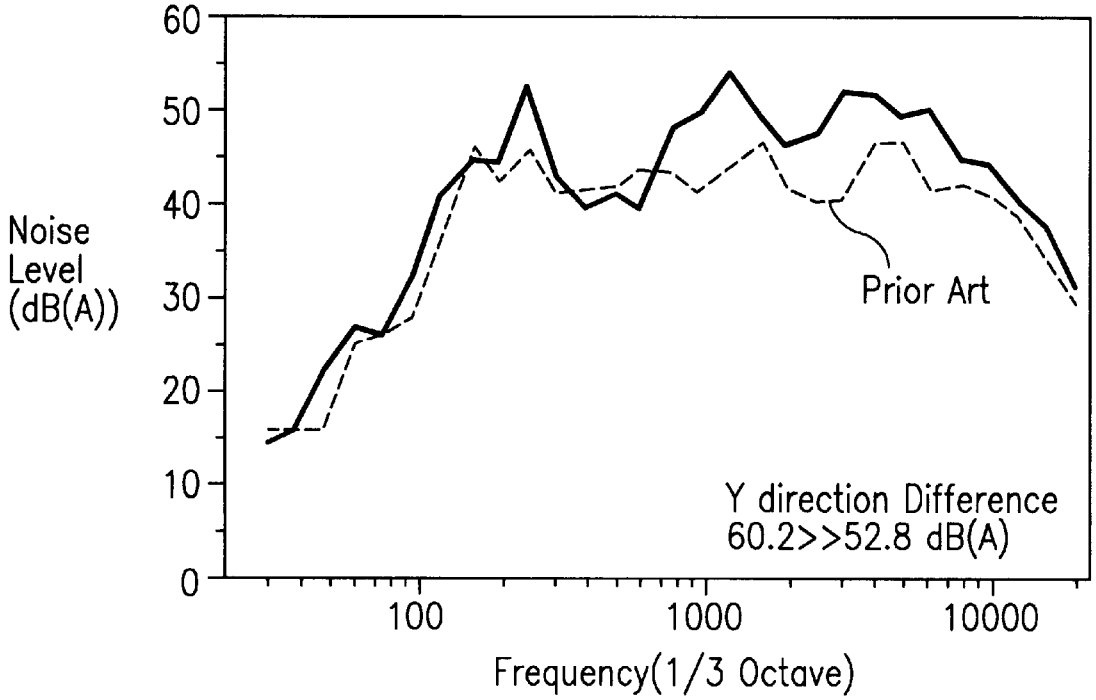

First, the rotary compressor of the present invention has a compressed refrigerant to flow from the compression chamber 'C' to the inside of the muffler 70, be attenuated of noise therein, pass through the hollow 4*b* in the shaft 4, and flow to the upper portion of the case 1. That is, because the compressed refrigerant flows through the hollow 4*b,* attenuation of the noise generated by the refrigerant pressure fluctuation and kinetic turbulent energy is doubled. Accordingly, the rotary compressor of the present invention has an advantage in that the noise emitted to outside of the rotary compressor can be reduced effectively. FIGS. 7A and 7B illustrate graphs of noise levels of rotary compressors in the related art and the present invention measured in an X- and Y-directions, referring to which the noise attenuation will be explained. According to a result of the experiment, it can be known that the rotary compressor of the present invention has a noise level lower by approx. 8 dB than the related art. And, there is a very small difference of X- and Y-direction noise levels of 0.2 dB.

Second, the lubrication between the main bearing 14 and the shaft 4 by the lubrication oil from the lubrication cavity 86 between the main bearing 14 and the shaft 4, which oil is an accumulation of lubrication oil in the lubrication cavity from the oil contained in the refrigerant, enhances a lubrication performance, that permits provision of a smaller lubrication oil pump, which in turn improves a compressor overall efficiency.

Third, the reduction of the eccentric load to the shaft 4 by an appropriate combination of the positions of the first and second discharge openings 82 and 84 can prolong a lifetime of the shaft 4.

It will be apparent to those skilled in the art that various modifications and variations can be made in the rotary compressor of the present invention without departing from the spirit or scope of the invention. Thus, it is intended that the present invention cover the modifications and variations of this invention provided they come within the scope of the appended claims and their equivalents.

What is claimed is:

1. A rotary compressor, comprising:

a main bearing, which is a component for forming a compression chamber, the main bearing having a discharge passage for discharging a compressed gas and a boss for inserting a shaft of a driving unit therethrough; and a muffler on a top of the main bearing having a boss hole for passing the boss of the main bearing therethrough and provided for attenuation of a noise, wherein the muffler has no separate discharge opening for compressed gas, the boss of the main bearing has a plurality of first discharge openings, and the shaft has a hollow and a plurality of second discharge openings in communication with the first discharge openings.

2. The rotary compressor as claimed in claim 1, further comprising:

a lubrication cavity between the first discharge openings in the main bearing and the second discharge openings in the shaft, for collection of a lubrication oil mixed with a refrigerant.

3. The rotary compressor as claimed in claim 1, wherein the plurality of the second discharge openings in the main bearing are formed at positions opposite to the discharge passage in the main bearing, for reducing an eccentric load on the shaft.

4. The rotary compressor as claimed in claim 1, further comprising:

an outer casing;

a compression unit disposed within the outer casing for compressing a gas, the compression unit comprising the compression chamber; and a driving unit for providing a rotary force to the compression unit.

5. The rotary compressor as claimed in claim 4, wherein the compression chamber is delimited by a cylinder forming a wall thereof, the main bearing mounted at upper side of the compression chamber, and a supplementary bearing mounted at a lower side of the compression chamber, wherein the driving unit provides a rotary force to the cylinder.

6. The rotary compressor as claimed in claim 5, further comprising:

a suction pipe for drawing a gas into the compression chamber; and a discharge pipe for discharging compressed gas from the compression chamber, wherein the discharge pipe is in fluid communication with the discharge passage of the main bearing.

7. The rotary compressor as claimed in claim 5, wherein the driving unit comprises a motor.

8. The rotary compressor as claimed in claim 1, wherein the driving unit comprises a motor.

9. The rotary compressor as claimed in claim 1, wherein the rotary compressor forms a part of an air conditioner.

10. The rotary compressor as claimed in claim 1, wherein the gas is a refrigerant.

11. A rotary compressor, comprising:

a main bearing, which is a component for forming a compression chamber, the main bearing having a discharge passage for discharging a compressed gas and a boss for inserting a shaft of a driving unit therethrough; and a muffler on a top of the main bearing having a boss hole for passing the boss of the main bearing therethrough and provided for attenuation of a noise, wherein the muffler has no separate discharge opening for compressed gas, a top of the muffler is extended over a top of the boss of the main bearing, and the shaft has a hollow and a plurality of refrigerant discharge openings.

12. The rotary compressor as claimed in claim 11, further comprising:

an outer casing;

a compression unit disposed within the outer casing for compressing a gas, the compression unit comprising the compression chamber; and a driving unit for providing a rotary force to the compression unit.

13. The rotary compressor as claimed in claim 12, wherein the compression chamber is delimited by a cylinder forming a wall thereof, the main bearing mounted at upper side of the compression chamber, and a supplementary bearing mounted at a lower side of the compression chamber, wherein the driving unit provides a rotary force to the cylinder.

14. The rotary compressor as claimed in claim 13, further comprising:

a suction pipe for drawing a gas into the compression chamber; and a discharge pipe for discharging compressed gas from the compression chamber, wherein the discharge pipe is in fluid communication with the discharge passage of the main bearing.

15. The rotary compressor as claimed in claim 13, wherein the driving unit comprises a motor.

16. The rotary compressor as claimed in claim 11, wherein the driving unit comprises a motor.

17. The rotary compressor as claimed in claim 11, wherein the rotary compressor forms a part of an air conditioner.

18. The rotary compressor as claimed in claim 11, wherein the gas is a refrigerant.

* * * * *